United States Patent [19]

Primozic

[11] Patent Number: 4,953,363

[45] Date of Patent: Sep. 4, 1990

[54] FLORAL DISPLAY CASE

[75] Inventor: Randolph J. Primozic, Willoughby Hills, Ohio

[73] Assignee: Floraline Display Products Corp., Willoughby, Ohio

[21] Appl. No.: 450,174

[22] Filed: Dec. 13, 1989

[51] Int. Cl.[5] ..... A47F 3/04

[52] U.S. Cl. ..... 62/255; 47/41.11; 312/116

[58] Field of Search ..... 62/247, 249, 255, 256; 47/41.11, 41.01; 248/27.8; 312/116, 128

[56] References Cited

U.S. PATENT DOCUMENTS

| | | | |
|---|---|---|---|
| 875,234 | 12/1907 | Bastel | 47/34.12 |
| 2,081,048 | 5/1937 | Bate | 62/249 |
| 2,896,374 | 7/1959 | Perin | 47/1.2 |
| 3,365,840 | 1/1968 | Cooper | 47/34.12 |
| 3,369,375 | 2/1968 | Gerweck et al. | 62/256 |
| 3,686,792 | 8/1972 | Barfield | 47/39 |
| 3,841,023 | 10/1974 | Carlyon | 47/38 |
| 4,179,900 | 12/1979 | Corrigan | 62/231 |
| 4,255,896 | 3/1981 | Carl | 47/62 |
| 4,295,296 | 10/1981 | Kinghorn | 47/82 |
| 4,324,069 | 4/1982 | Flagg | 47/62 |
| 4,458,501 | 7/1984 | Kooy | 62/256 |
| 4,608,776 | 9/1986 | Kooy | 47/58 |
| 4,608,835 | 9/1986 | Kooy | 62/256 X |
| 4,612,777 | 9/1986 | Noma et al. | 62/247 |
| 4,680,942 | 7/1987 | Kooy | 62/256 |

*Primary Examiner*—William E. Tapolcai

*Attorney, Agent, or Firm*—Jones, Day, Reavis & Pogue

[57] ABSTRACT

A display case for bouquets of cut flowers provides water and a refrigerated environment for the flowers, while allowing completely upon customer access to the flowers for selective customer removal of same from the case.

33 Claims, 6 Drawing Sheets

FLORAL DISPLAY CASE

BACKGROUND OF THE INVENTION

This application relates to the art of display cases and, more particularly, to display cases for displaying perishable goods. The invention is particularly applicable for displaying bouquets of cut flowers and will be described with specific reference thereto. However, it will be appreciated that certain features of the invention have broader aspects and can be used for displaying other perishable goods.

Cut flowers are highly perishable, and maintaining same in a robust and pristine condition for relatively long time periods is very difficult. Good maintenance of cut flowers requires a refrigerated environment and fresh water.

It would be desirable to display bouquets of cut flowers in an aesthetically pleasing manner for selection by customers, while also providing refrigeration and water.

SUMMARY OF THE INVENTION

A display case of the type described includes support means for supporting a plurality of bouquets of cut flowers. The case has an overhead portion spaced above and overlying the flower support means. A cascade of refrigerated air is supplied through the overhead portion for descent upon the flowers. Air curtain supply means is provided in the overhead portion for supplying a narrow curtain of air for descent along an open front of the case through which customers may gain access to flower bouquets supported by the support means.

In a preferred arrangement, the velocity of the curtain of air along the open front of the case is substantially greater than the velocity of the cascade of refrigerated air.

In accordance with another aspect of the invention, humidifier means is provided for supplying moisture to the refrigerated air. A humid environment prolongs the life of the cut flowers and also improves the appearance of the flowers.

The flower bouquet support means includes a plurality of elongated tubular manifolds extending substantially horizontally and parallel to one another in spaced-apart upwardly terraced relationship from the open front of the case toward the case back wall. Each manifold has a plurality of spaced-apart upwardly facing openings therein for receiving and supporting stem portions of cut flower bouquets.

Air stabilizing means may be provided between the back wall of the case and the tubular manifolds for stabilizing the mixture and movement of air in the space between the back wall and the manifolds.

Water supply means is provided for supplying water to each of the manifolds, and water level control means is provided for maintaining a predetermined water level in each manifold.

Flushing means is provided for automatically flushing debris from the manifolds and changing the water therein at selective intervals.

The openings in the manifolds for receiving and supporting cut flower bouquets have a peripheral wall that is of generally inverted frusto-conical shape.

A bottom drain in each manifold may be selectively opened and closed by an automatic valve for completely flushing debris from each manifold and changing the water therein.

It is a principal object of the present invention to provide a flower display case that maximizes the shelf life of the flowers.

It is another object of the invention to provide a flower display case that automatically maintains an optimum environment for bouquets of cut flowers.

It is an additional object of the invention to provide a flower display case that provides a maximum display area for a limited amount of space.

It is a further object of the invention to provide automatic water level and flushing systems for a flower display case.

It is also an object of the invention to provide a flower display case for displaying bouquets of cut flowers in an attractive setting while allowing direct customer access to the flowers.

DESCRIPTION OF THE PREFERRED EMBODIMENTS

Figure 1:
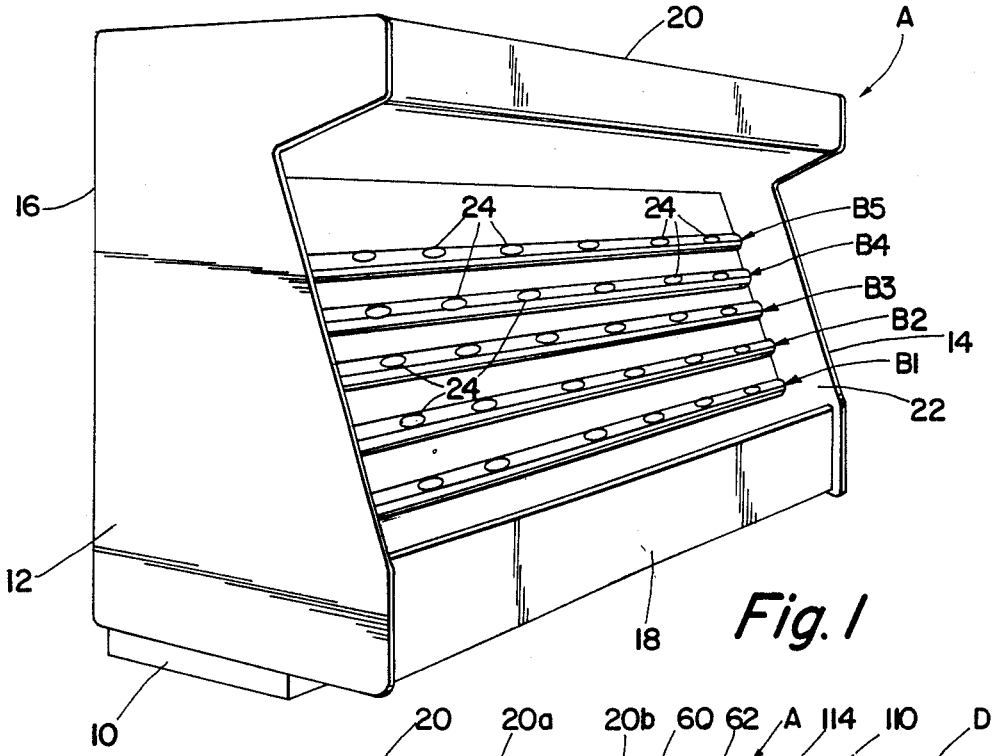
FIG. 1 is a perspective illustration of a flower display case constructed in accordance with the present application.

Referring now to the drawing, wherein the showings are for purposes of illustrating certain preferred embodiments of the invention only and not for purposes of limiting same, FIG. 1 shows a display case A having a base 10, opposite side walls 12, 14, a back wall 16, a front skirt 18, an overhead portion 20, and a completely open front 22 between skirt 18 and overhead portion 20. Support means for supporting bouquets of cut flowers within case A comprise a plurality of elongated tubular manifolds B1–B5. Each manifold B1–B5 has a plurality of spaced-apart upwardly facing openings 24 therein.

Figure 2:
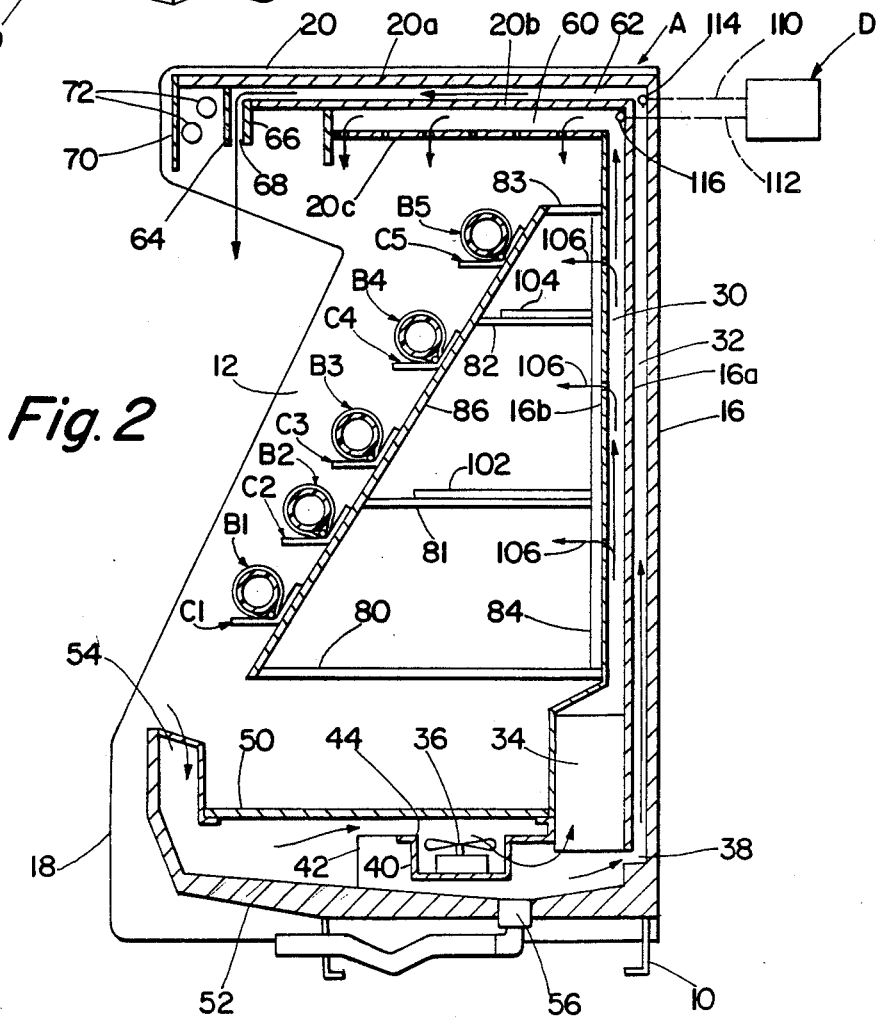
FIG. 2 is a cross-sectional elevational view of the display case.

With reference to FIG. 2, spaced back walls 16, 16*a* and 16*b* define primary and secondary vertical air flow passages 30, 32. A refrigeration unit 34 is mounted in the lower rear portion of the case. A blower 36 supplies air through refrigeration unit 34 to primary air flow passage 30. Blower 36 also supplies air to secondary air flow passage 32 through a bottom inlet 38.

Blower 36 is suspended by an open support cage 40 from a support 42 having an inlet opening 44 to blower 36. It will be recognized that a plurality of blower units are mounted in spaced relationship across the bottom portion of the display case. A false bottom 50 is spaced above bottom wall 52 in covering relationship to the blowers. An air inlet 54 for the blowers extends along the entire front portion of display case A. A drain 56 is provided in bottom 52 for connection to a suitable sewer line.

Spaced top walls 20*a*, 20*b* and 20*c* define horizontally extending primary and secondary air floW passages 60, 62 that respectively form continuations of vertical air flow passageways 30, 32. The area of top wall 20*c* has at least 40% openings therein, and may be of metal mesh or grid. Perforate top wall 20*c* occupies a substantial area of overhead portion 20. Small vertical panels 64, 66 cooperate with top walls 20*a*, 20*b* to define an elongated downwardly directed discharge outlet 68 for secondary air that extends along substantially the entire length of overhead portion 20. A front baffle 70 is provided for concealing fluorescent lights 72 that illuminate objects displayed in the case.

Figure 3:
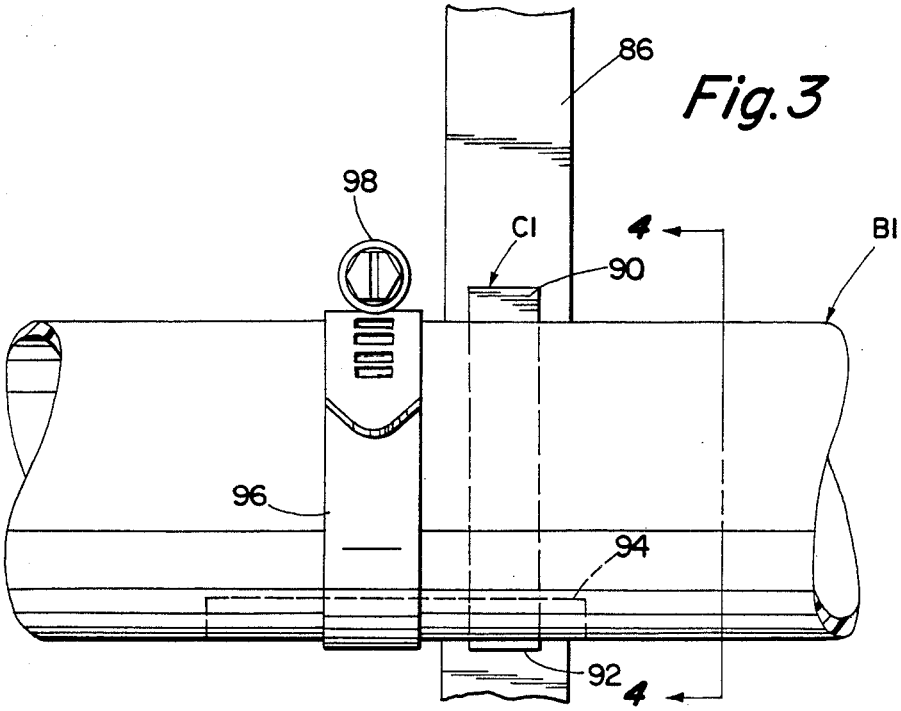
FIG. 3 is a partial front elevational view showing how a tubular manifold is supported in the display case.
Figure 4:
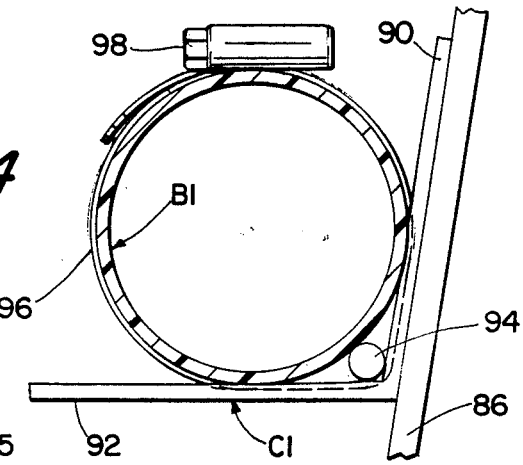
FIG. 4 is a partial cross-sectional elevational view taken generally on line 4—4 of FIG. 3.

The support members for supporting tubular manifolds B1–B5 may be metal channel having slots and holes therein, and angle iron having slots and holes therein. Hooked shelf bracket-type of horizontal supports or connecting members may also be used. The horizonal support members can be welded to or integral with a vertical component which is secured to a vertical channel in the back wall of the case. Referring to FIG. 2, a plurality of vertically spaced horizontal support members of different lengths 80–83 are secured to and extend outwardly from a vertical support member 84. An inclined support member 86 is attached to the outer end portions of horizontal support members 80–83. Inclined support member 86 is inclined rearwardly toward back wall 16 from the lower end thereof toward the upper end thereof. A plurality of manifold supports C1–C5 are attached to inclined support member 86 in spaced-apart relationship With reference to FIGS. 3 and 4, manifold support C1 has an upright leg 90 that is welded or otherwise suitably attached to inclined support member 86. Manifold support C1 has an integral horizontal leg 92 extending outwardly from inclined support member 86 in a direction away from display case back wall 16. A short length of rod 94 is welded to manifold support C1 at the intersection of legs 90, 92. Tubular manifold B1 is supported on manifold support C1 as shown in FIGS. 3 and 4. A conventional hose clamp 96 is positioned around tubular manifold B1 and around rod 94. Adjustment of clamp band screw 98 then securely clamps' tubular manifold B1 to rod 94 and to manifold support C1. The other manifold supports C2–C5 are made similar to the described arrangement for support C1.

It will be recognized that there are a plurality of vertical support members 84, and associated horizontal and inclined support members 80–86 at laterally spaced-apart locations across the width of display case A between opposite sides 12, 14 thereof. The number of supports will depend upon the length of the display case and the number of tubular manifolds to be supported therein. With the arrangement shown and described, tubular manifolds B1–B5 extend substantially horizontally and parallel to one another, and are spaced-apart in upwardly terraced relationship from the open front of display case A toward the back wall 16 thereof The upwardly facing openings 24 in the manifolds are for receiving and supporting stem portions of cut flower bouquets.

Elongated horizontal shelf members 102, 104 may be positioned on horizontal supports 81, 82 as shown in FIG. 2. Shelf members 102, 104 are in the space between tubular manifolds B1–B5 and back wall 16. Shelf members 102, 104 define air stabilizing means for stabilizing the mixture and movement of air in the space between the manifolds and the back wall of the display case. A plurality of small holes may be provided in secondary back wall 16*b* for allowing flow of some primary refrigerated air from refrigerated air passage 30 into the space between the manifolds and back wall 16*b* as shown by arrows 106. When such holes are provided in secondary back wall 16*b*, they are very small and few in number such that the amount of refrigerated air flowing therethrough is a very small percentage of the total refrigerated air flowing through passage 30. Therefore, a substantial majority of the refrigerated air exits through perforate top wall member 20*c* to descend in a cascade upon tubular manifolds B1–B5. The velocity of the refrigerated air is very low for minimizing any damage to the flowers. High velocity air flow and turbulent air flow are undesirable in the area of the flowers. The air curtain flowing along the open front of the case through outlet 68 is of very high velocity compared to the velocity of the refrigerated air.

An ultrasonic humidifier D may be provided for supplying moisture to one or both of the primary and secondary air. Tubular members 110, 112 extend from humidifier D to elongated tubular members I14, 116 in primary and secondary air flow passages 30, 32. A plurality of spaced-apart outlets are provided in tubular members 114, 116 for injecting moisture into the air streams.

It is obvious that a thermostat may be provided for controlling refrigeration unit 34 and that a humidistat may be provided for controlling the operation of humidifier D if so desired. Simply by way of example, and not by way of limitation, a humidifier used with the display case of the present application may be of the type disclosed in U.S. Pat. Nos. 4,238,425 issued Dec. 9, 1980, and 4,257,989 issued Mar. 24, 1981. The ultrasonic humidifier includes a small water chamber having an associated ultrasonic transducer that atomizes the water and a fan directs the atomized water to a desired location.

Figure 9:
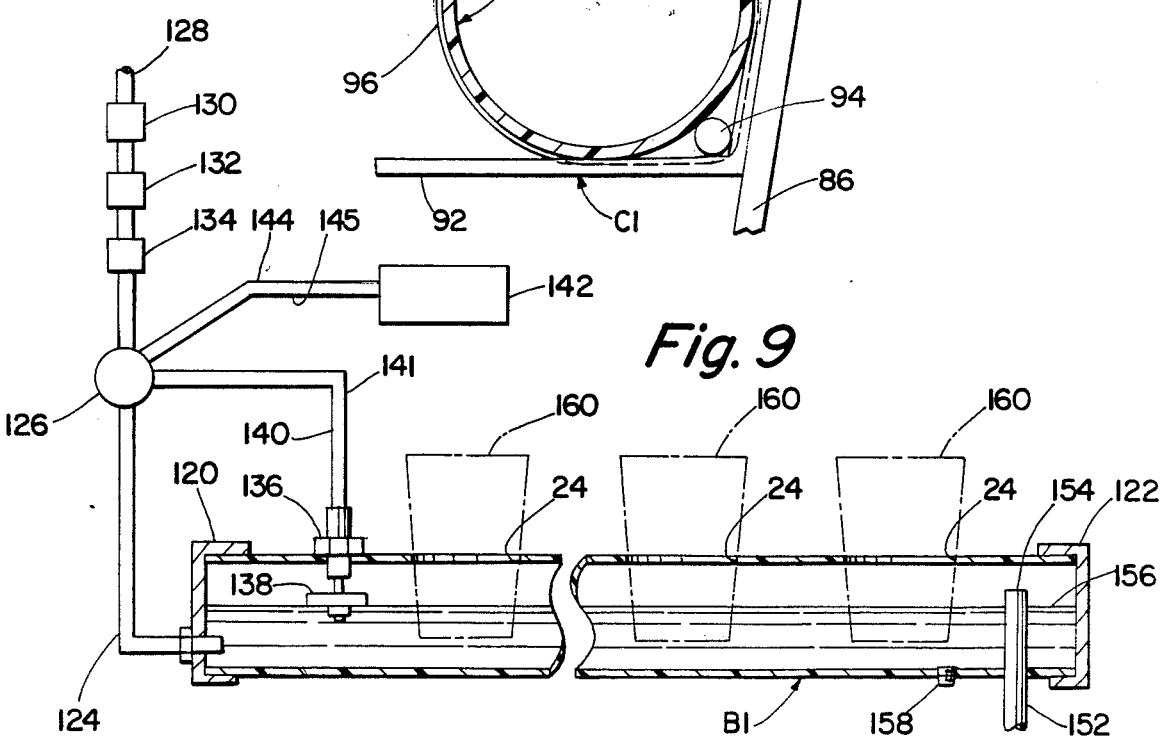
FIG. 9 is a diagrammatic front elevational view showing a water supply arrangement for a tubular manifold.

Referring to FIG. 9, tubular manifold B1 is provided with end caps 120, 122. A water supply conduit 124 communicates with the interior of tubular manifold B1 through end cap 120. Water flow through water supply conduit 124 is controlled by a solenoid valve 126. A water supply conduit 128 connected with a water main communicates with solenoid valve 126 through a flow control pressure reducer 130, a chlorine filter 132 and a phosphate filter 134.

Figure 15:
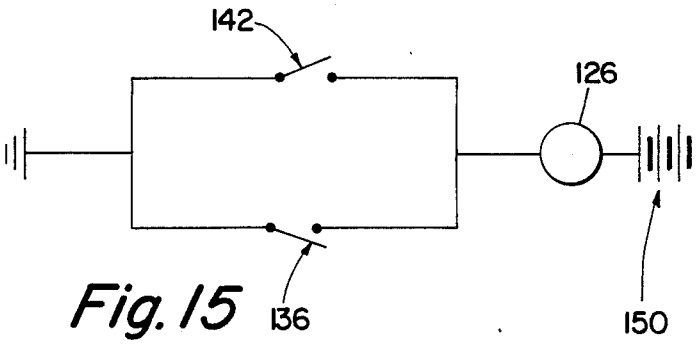
FIG. 15 is a diagrammatic illustration of a circuit for operating a water inlet valve.

A magnetic reed float switch 136 is mounted on an upper portion of manifold B1 and has a float 138 inside of manifold B1. Magnetic reed float switch 136 is connected by wires 140, 141 with solenoid valve 126. A timer 142 is connected with solenoid valve 126 by wires 144, 145. FIG. 15 is a schematic showing of solenoid valve 126 connected to a voltage source 150 for selective opening of the valve by closing of either magnetic reed float switch 136 or timer switch 142. A separate solenoid valve is provided for each manifold, while a single timer 142 is connected for opening all of the solenoid valves at selected intervals.

Referring again to FIG. 9, an outlet conduit 152 extends upwardly into manifold B1 through the bottom thereof and has an open upper end 154 located a predetermined distance above the bottom portion of the manifold. Open upper end 154 is also positioned above the normal water level 156 maintained within manifold B1 by magnetic reed switch 136. A removable bottom plug 158 may be provided in manifold B1 for completely draining same.

Magnetic reed switch 136 is arranged to maintain tubular manifold B1 at least about one-half full of water. Plastic cups 160 of inverted frusto-conical shape are received in manifold openings 124 and have perforate bottoms submerged in the water. Stem portions of cut flower bouquets received in cups 160 are also submerged in the water within the bottom portions of the cups. Obviously, stem portions of cut flower bouquets may be directed inserted through the openings 24 without the use of cups 160 if so desired.

At predetermined intervals, such as every 6–8 hours, timer 142 operates to open solenoid valve 126 for a predetermined period of time for completely flushing manifold B1 and changing the water therein. When solenoid valve 126 opens by operation of timer 142, the water level rises in manifold B1 until it overflows through open top end 154 of discharge conduit 152. Decaying matter and debris are then flushed from manifold B1 for discharge through conduit 152 which is connected to a sanitary drain. This provides the flowers with a fresh source of natural nutrients present in fresh water supplies. This also maintains a clean environment to inhibit the growth of bacteria, and to minimize the possibility of odors caused by decaying matter. After a predetermined flushing period, timer 142 operates to again close solenoid valve 126 which then returns to the control of magnetic reed float switch 136.

Figure 10:
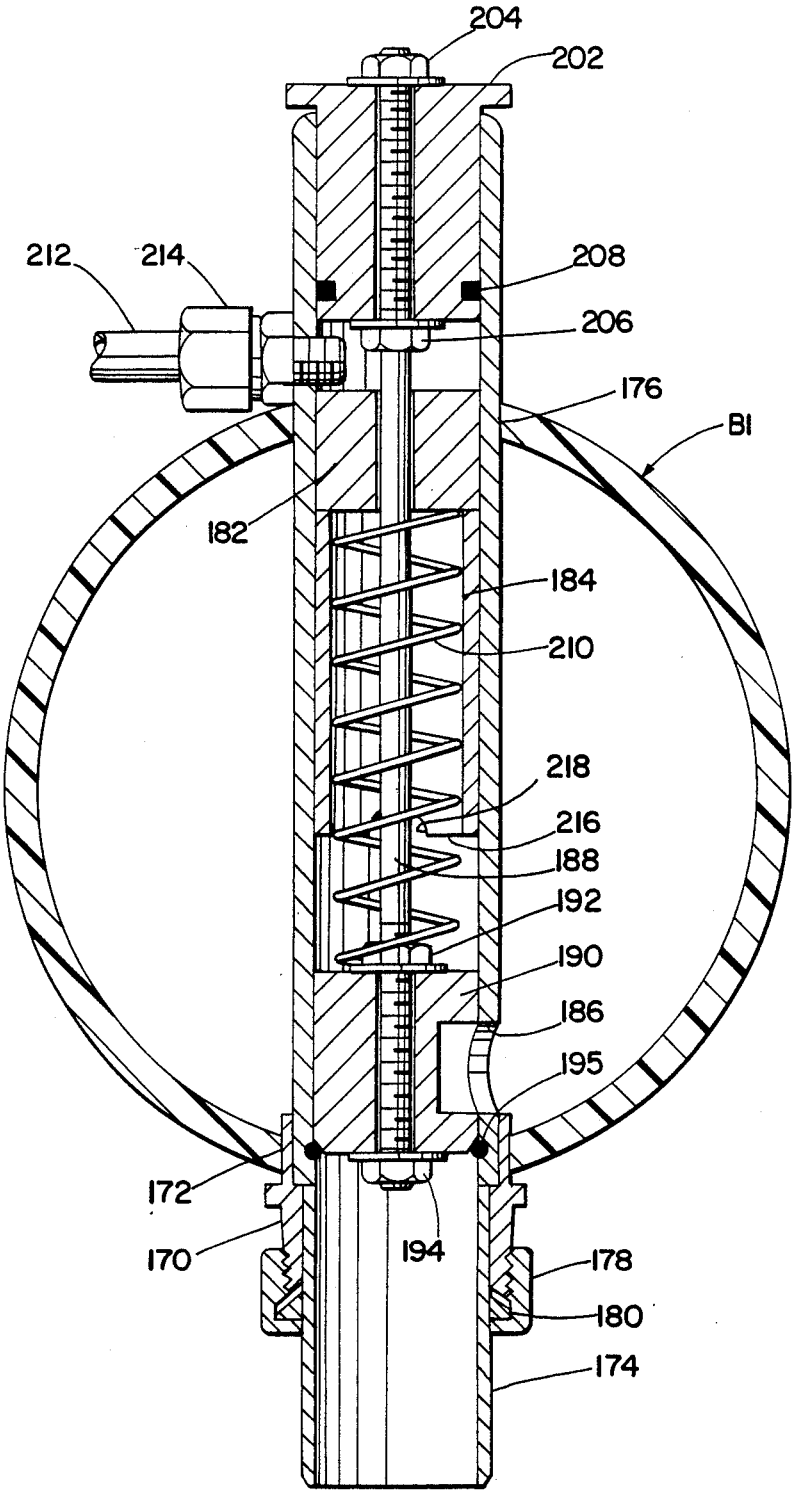
FIG. 10 is a cross-sectional elevational view of an automatic flushing valve.

Instead of using an overflow discharge conduit 152, it will be recognized that it is possible to use a motorized valve connected for operation by timer 142. Thus, when timer 142 operates to open solenoid valve 126, it would also open the motorized discharge valve for opening a bottom outlet in manifold B1. Another arrangement for an automatic bottom discharge valve is shown in FIG. 10. A threaded fitting 170 is bonded within an opening 172 in the bottom portion of manifold B1. An elongated cylindrical sleeve 174 extends through fitting 170 and through an opening 176 in the top portion of manifold B1. A packing gland 178 is threaded on fitting 170 and has a packing 180 for sealing around an tightly gripping sleeve 174.

A shaft guide member 182 and a spring guide member 184 are bonded to the interior surface of sleeve 174 in the positions shown. A lateral opening 186 in sleeve 174 near the bottom portion of manifold B1 is provided for discharging water therefrom An elongated rod 188 has a valve member 190 attached to one end portion thereof as by nut and washer assemblies 192, 194 threaded onto a threaded end portion of the rod. Valve member 190 cooperates with an O-ring 195 received in a suitable circumferential groove within sleeve member 174 to normally close sleeve 174 against discharge of water therethrough.

The opposite threaded end portion of rod 188 has a piston 202 attached thereto by nut and washer assemblies 204, 206. An O-ring 208 received in a suitable circumferential groove in piston 202 cooperates with the interior surface of sleeve 174. A spring 210 biases against guide member 182 and valve member 190 for normally engaging valve member 190 with O-ring 194. A water supply conduit 212 connected with sleeve member 174 by a suitable fitting 214 communicates with a space between guide member 182 and piston 202. When timer 142 of FIG. 9 is operated to open solenoid valve 126, conduit 212 is also connected with the solenoid valve so that water pressure enters the space between guide member 182 and piston 202 for shifting piston 202 upwardly against the biasing force of spring 210. Valve member 190 then bottoms out against an end 216 of spring guide member 184, and sleeve opening 186 is completely open to discharge water from manifold B1. This advantageous arrangement provides better flushing of debris from the manifold because the discharge outlet is directly adjacent the bottom of the manifold. It will be recognized that an automatic valve of the type shown in FIG. 10 is provided for each manifold B1–B5. All of the discharge sleeves 174 on each manifold are connected to a suitable sanitary drain.

The central hole through guide member 182 has sufficient clearance around rod 188 to leak water. This provides automatic flushing of the valve and also relieves pressure on piston 202 when the solenoid valve closes so that spring 210 can move valve member 190 back to its closed position. One or more lateral notches 218 in end 216 of spring guide and valve stop member 184 allow passage of water when valve member 190 is in its open position against end 216.

Figure 5:
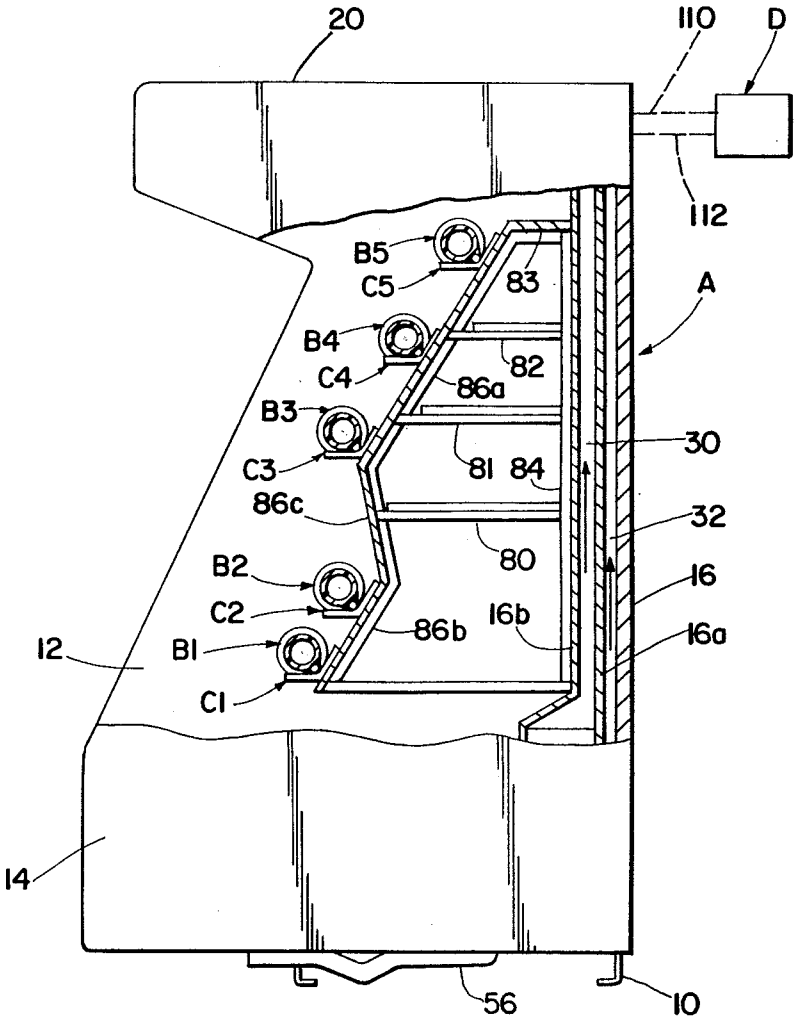
FIG. 5 is a cross-sectional side elevational view similar to FIG. 2 and showing a modified arrangement.

FIG. 5 shows a modified arrangement wherein there are a pair of inclined support members **86*a*, 86*b* connected with one another by a connecting support 86*c*. Some of the tubular manifolds are then supported on lower inclined support member 86*b* and other tubular manifolds are supported on upper inclined support member 86*a*. Inclined supports 86*a*, 86*b*** may be offset a predetermined distance, and may or may not be parallel to one another, for optimizing use of the display area and space within the case.

Figure 6:
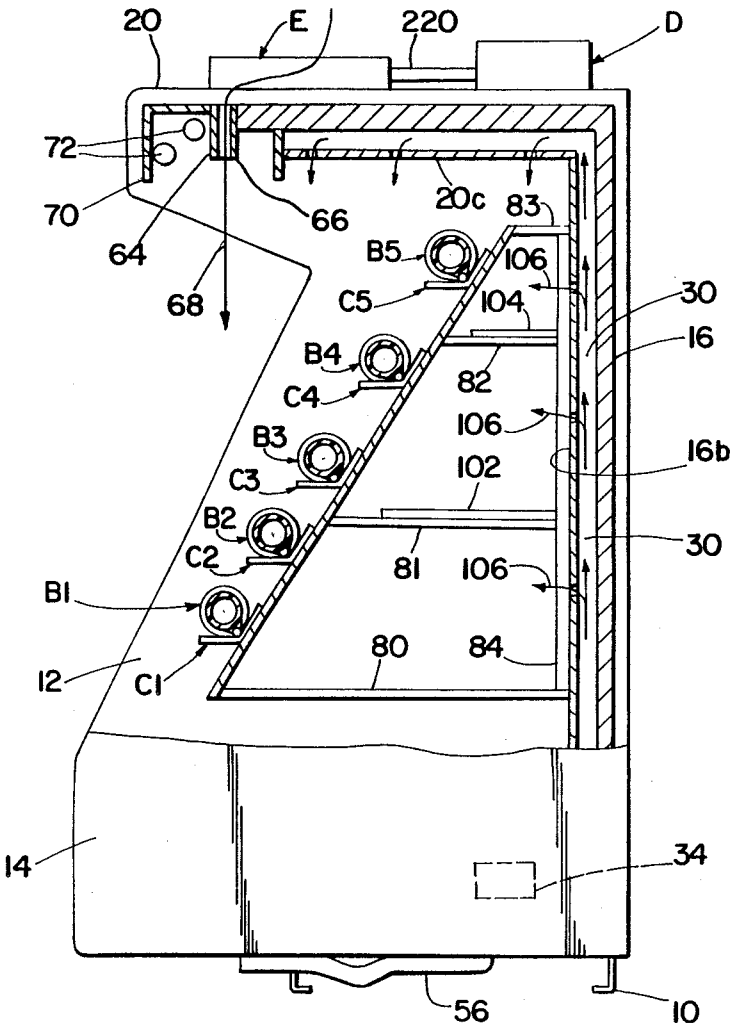
FIG. 6 is a cross-sectional side elevational view similar to FIGS. 2 and 5, and showing another modified arrangement.

FIG. 6 shows another arrangement which omits the vertical secondary airflow passage 32 of FIG. 2. In the arrangement of FIG. 6, a separate blower E is mounted on the upper portion 20 of the case for supplying the curtain of secondary air through outlet 68. Humidifier D may be directly connected as by conduit 220 for humidifying the secondary air.

Figure 7:
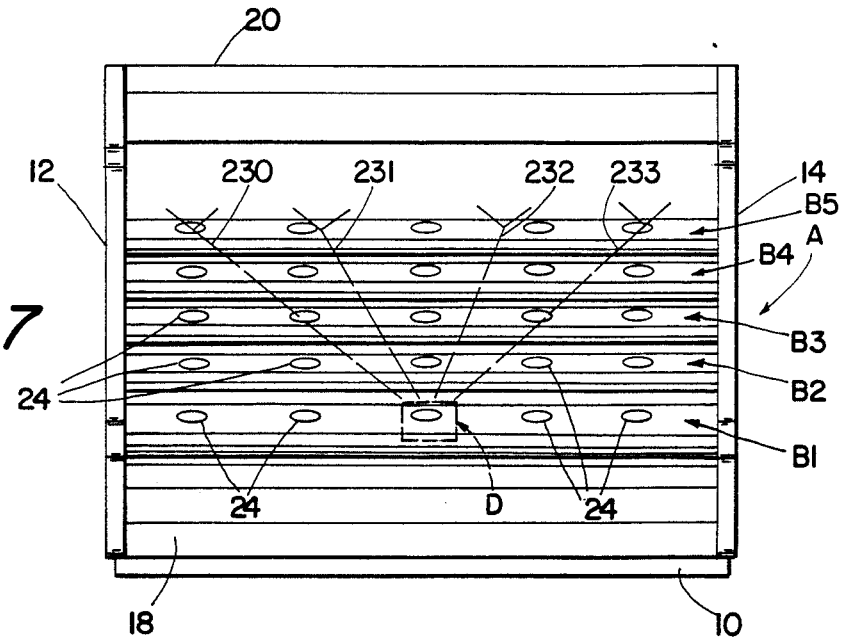
FIG. 7 is a front elevational view of another modified arrangement.
Figure 8:
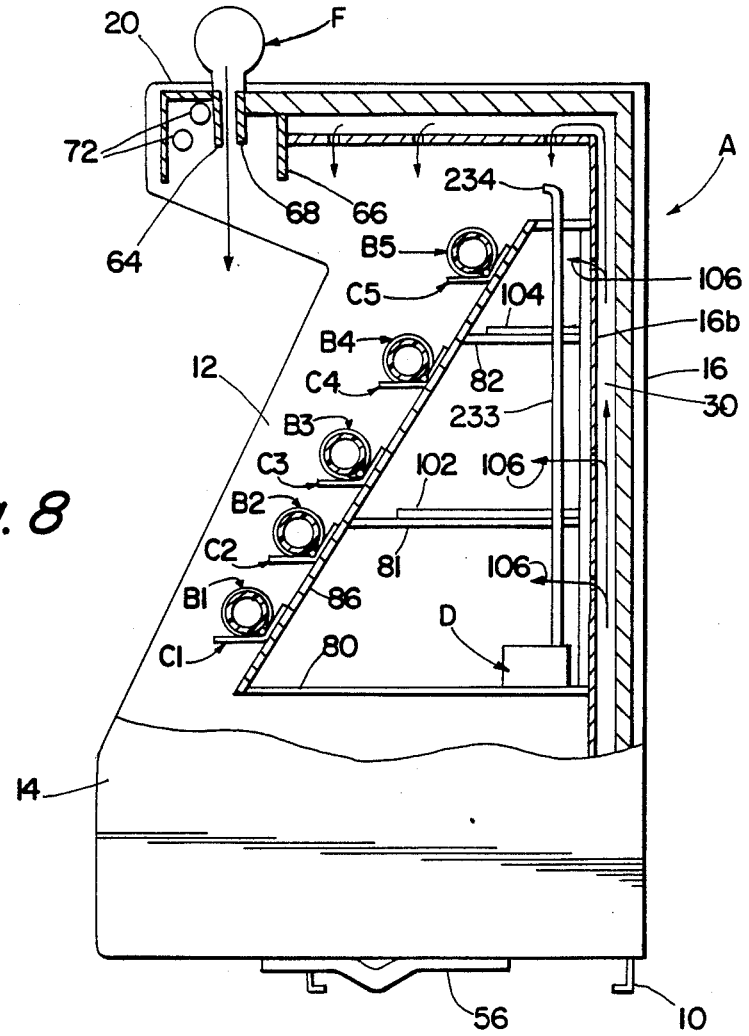
FIG. 8 is a cross-sectional side elevational view of the modified display case of FIG. 7.

FIGS. 7 and 8 show another arrangement wherein ultrasonic humidifier D is mounted in the space between the inclined manifold support and the back wall of the case. A plurality of tubes 230–233 diverge upwardly from humidifier D adjacent the back wall of the case. Tubes 232 terminate in horizontally extending outlets shown at 234 in FIG. 8 for tube 233. A plurality of the humidifier tubes 230–233 are preferably provided with their discharge outlets being equi-distantly spaced from one another above the uppermost manifold B5. In the arrangement of FIGS. 7 and 8, a separate secondary blower F is provided for supplying the high velocity curtain of air through outlet 68.

Figure 11:
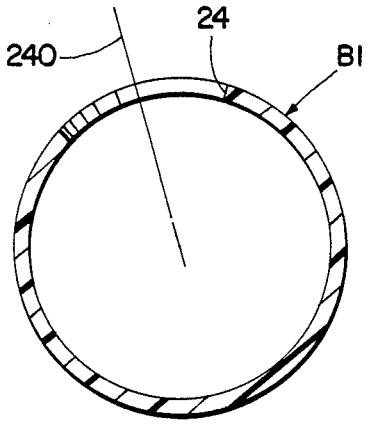
FIG. 11 is a cross-sectional elevational view of a tubular manifold having an opening therein.
Figure 12:
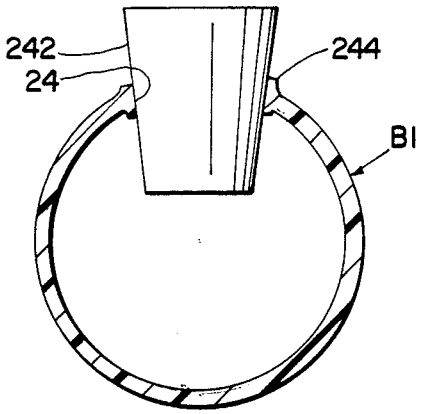
FIG. 12 is a cross-sectional elevational view of a tubular manifold showing how a mandrel is used for shaping each opening in the manifold.
Figure 13:
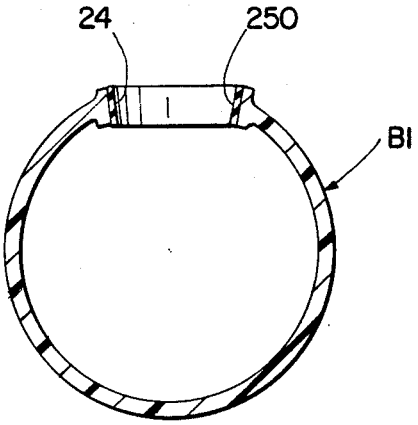
FIG. 13 is a cross-sectional elevational view of a manifold showing an opening lined with an elastomeric material.
Figure 14:
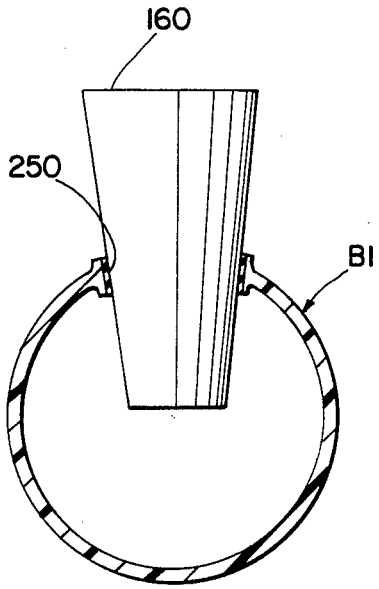
FIG. 14 is a cross-sectional elevational view similar to FIG. 13 and showing a cup-like receptacle received in the manifold opening.

FIG. 11 shows the preferred position of each manifold with center line 240 of an opening 24 inclined forwardly toward the open front of the display case at an angle of 5°–30°. The tubular manifolds are preferably made of a plastic material, such as a foam core ABS. Circular openings 24 are first cut in a manifold. The peripheral portion of the opening is then heated and a heated mandrel 242 in FIG. 12 is forced into the opening. The mandrel is of generally inverted frusto-conical shape. This causes the peripheral portion of the opening to take on an inverted frusto-conical shape, and the material of the mandrel becomes substantially thicker around the periphery of the opening as shown at 244 in FIGS. 12–14. This is because the wedging action of the mandrel 242 against the softened plastic causes same to flow outwardly around the opening. As shown in FIG. 13, the periphery of the opening 24 is then preferably lined with a relatively soft elastomeric material 250, such as a silicone rubber. A plastic flower bouquet support cup 160 of FIG. 14 will then be gripped by the elastomeric material 250 so that the cup is not loose within an opening. At the same time, a customer can readily remove a cup and its associated bouquet from an opening. With reference to FIG. 9, the arrangement shown and described provides water supply means for supplying water to each of the tubular manifolds. The magnetic reed float switches provide water level control means for maintaining a predetermined water level in each manifold. The timer, solenoid valve and discharge outlet provide flushing means for selectively flushing debris from the manifolds and changing the water therein. The timer provides automatic means for automatically operating the flushing means at selective intervals.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A display case for cut flowers, said case having a back wall and an open front, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets, said case having a space between said back wall and said manifolds, and air stabilizing means in said space between said back wall and said manifolds for stabilizing movement and mixture of air in such space.

2. The case of claim 1 wherein said air stabilizing means comprises a plurality of vertically-spaced generally horizontally extending shelves in said space between said back wall and said manifolds.

3. The case of claim 1 including refrigerated air outlet openings in said back wall positioned for supplying refrigerated air to said space between said back wall and said manifolds.

4. The case of claim 3 wherein said refrigerated air outlet openings in said back wall are such that the volume and flow rate of refrigerated air through said back wall outlet openings is substantially less than the volume and flow rate of refrigerated air through said overhead portion.

5. The case of claim 1 wherein each said manifold has a peripheral wall between inner and outer peripheral surfaces, each said manifold opening having an opening periphery lying substantially on the surface of a cone such that said opening periphery at the intersection thereof with said manifold inner peripheral surface is smaller than the intersection thereof with said manifold outer peripheral surface.

6. The case of claim 5 wherein each said opening periphery is coated with elastomeric material.

7. The case of claim 5 wherein each said manifold opening periphery has a thickness greater than the thickness of said manifold peripheral wall.

8. A display case for cut flowers, said case having a back wall and an open front, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets, water supply means for supplying water to each of said manifolds, and water level control means for maintaining a predetermined water level in each of said manifolds.

9. The case of claim 8 including flushing means for flushing debris from said manifolds and changing the water therein.

10. The case of claim 9 including automatic means for automatically operating said flushing means at selective intervals.

11. The case of claim 8 wherein each said manifold has a peripheral wall between inner and outer peripheral surfaces, each said manifold opening having an opening periphery lying substantially on the surface of a cone such that said opening periphery at the intersection thereof with said manifold inner peripheral surface is smaller than the intersection thereof with said manifold outer peripheral surface.

12. The case of claim 11 wherein each said opening periphery is coated with elastomeric material.

13. The case of claim 11 wherein each said manifold opening periphery has a thickness greater than the thickness of said manifold peripheral wall.

14. A display case for cut flowers, said case having a back wall and an open front, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets, water supply means for supplying water to each of said manifolds, and flushing means for periodically flushing said manifolds to remove debris therefrom and change the water therein.

15. The case of claim 14 including automatic means for automatically operating said flushing means at selective intervals.

16. The case of claim 14 wherein each said manifold has a peripheral wall between inner and outer peripheral surfaces, each said manifold opening having an opening periphery lying substantially on the surface of a cone such that said opening periphery at the intersection thereof with said manifold inner peripheral surface is smaller than the intersection thereof with said manifold outer peripheral surface.

17. The case of claim 16 wherein each said opening periphery is coated with elastomeric material.

18. The case of claim 16 wherein each said manifold opening periphery has a thickness greater than the thickness of said manifold peripheral wall.

19. The case of claim 14 wherein each said mandrel has a bottom water outlet therein, a normally closed valve positioned in each said outlet for selectively opening or closing each said outlet, and said flashing means including valve operating means for selectively opening said valves.

20. The case of claim 19 wherein said valve is biased to a closed position and is moved to an open position by water pressure acting thereon.

21. A display case for cut flowers, said case having a back wall and an open front, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets, each said manifold having a manifold longitudinal axis, each said opening in each said manifold having a central opening axis extending radially from its manifold longitudinal axis, and said manifolds being positioned with said central opening axes inclined from the vertical forwardly toward said open front at an angle of at least 5°.

22. A display case for cut flowers, said case having a back wall, an open front and an overhead portion, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets which are viewable and physically accessible through said open front of said case, said overhead portion being spaced above and overlying said manifolds, refrigerated air supply means for supplying a cascade of refrigerated air through said overhead portion for decent upon said manifolds, air curtain supply means for supplying a narrow curtain of air through said overhead portion for descent along said open front of said case, and air stabilizing means extending between said back wall and said manifolds for stabilizing the mixture and movement of air in the space between said back wall and said manifolds.

23. The case of claim 22 wherein said air stabilizing means comprises a plurality of vertically-spaced shelves in said space between said back wall and said manifolds.

24. The case of claim 22 wherein said back wall has refrigerated air outlet openings therein for supplying refrigerated air to said space between said back wall and said manifolds.

25. The case of claim 24 wherein said refrigerated air outlet openings in said back wall are such that the volume and flow rate of refrigerated air through said back wall outlet openings is substantially less than the volume and flow rate of refrigerated air through said overhead portion.

26. A display case for cut flowers, said case having a back wall, an open front and an overhead portion, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets which are viewable and physically accessible through said open front of said case, said overhead portion being spaced above and overlying said manifolds, refrigerated air supply means for supplying a cascade of refrigerated air through said overhead portion for descent upon said manifolds, air curtain supply means for supplying a narrow curtain of air through said overhead portion for descent along said open front of said case, water supply means for supplying water to each of said manifolds, and water level control means for maintaining a predetermined water level in each of said manifolds.

27. The case of claim 26 including flushing means for flushing debris from said manifolds and changing the water therein.

28. The case of claim 27 including automatic means for automatically operating said flushing means at selective intervals.

29. A display case for cut flowers, said case having a back wall, an open front and an overhead portion, a plurality of elongated tubular manifolds extending substantially horizontally and parallel to one another and being spaced-apart in upwardly terraced relationship from said open front toward said back wall, each said manifold having a plurality of spaced-apart upwardly facing openings therein for receiving and supporting stem portions of cut flower bouquets which are viewable and physically accessible through said open front of said case, said overhead portion being spaced above and overlying said manifolds, refrigerated air supply means for supplying a cascade of refrigerated air through said overhead portion for descent upon said manifolds, air curtain supply means for supplying a narrow curtain of air through said overhead portion for descent along said open front of said case, water supply means for supplying water to each of said manifolds, and flushing means for periodically flushing said manifolds to remove debris therefrom and change the water therein.

30. The case of claim 29 including automatic means for automatically operating said flushing means at selective intervals.

31. A display case for cut flowers, said case having a back wall, an open front and an overhead portion, a plurality of elongated tubular manifolds extending substantially horizontally and parallel to one another and being spaced-apart in upwardly terraced relationship from said open front toward said back wall, each said manifold having a peripheral wall between inner and outer peripheral surfaces, each said manifold having a plurality of spaced-apart upwardly facing openings therein for receiving and supporting stem portions of cut flower bouquets which are viewable and physically accessible through said open front of said case, said overhead portion being spaced above and overlying said manifolds, refrigerated air supply means for supplying a cascade of refrigerated air through said overhead portion for descent upon said manifolds, air curtain supply means for supplying a narrow curtain of air through said overhead portion for descent along said open front of said case, and each said manifold opening having an opening periphery lying substantially on the surface of a cone such that the size of said opening periphery at the intersection thereof with said manifold inner peripheral surface is smaller than the intersection thereof with said manifold outer peripheral surface.

32. The case of claim 31 wherein each said manifold opening periphery is coated with elastomeric material.

33. The case of claim 31 wherein each said manifold opening periphery has a thickness greater than the thickness of said manifold peripheral wall.

* * * * *